US010790603B2

(12) United States Patent
Geng et al.

(10) Patent No.: US 10,790,603 B2
(45) Date of Patent: Sep. 29, 2020

(54) CONNECTOR WITH RELAXATION MECHANISM FOR LATCH

(71) Applicant: Intel Corporation, Santa Clara, CA (US)

(72) Inventors: Phil Geng, Portland, OR (US); Xiang Li, Portland, OR (US); George Vergis, Portland, OR (US); Mani Prakash, University Place, WA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 16/264,944

(22) Filed: Feb. 1, 2019

(65) Prior Publication Data

US 2019/0165503 A1 May 30, 2019

(51) Int. Cl.
*H01R 12/70* (2011.01)
*H01R 12/73* (2011.01)

(52) U.S. Cl.
CPC ..... *H01R 12/7023* (2013.01); *H01R 12/7005* (2013.01); *H01R 12/737* (2013.01); *H01R 12/707* (2013.01)

(58) Field of Classification Search
CPC ..... H01R 12/721; H01R 13/6275; H01R 13/6276; H01R 13/6335
USPC ..... 439/160, 327, 328, 358
See application file for complete search history.

(56) References Cited

U.S. PATENT DOCUMENTS 5,885,097 A * 3/1999 Chen ..... H05K 7/1405 439/328
6,132,228 A * 10/2000 Lang ..... H01R 13/62988 439/160
6,616,466 B2 * 9/2003 Frantum, Jr. ..... H01R 12/7005 439/157
7,341,467 B2 * 3/2008 Guan ..... H01R 13/6335 439/157
7,357,655 B1 * 4/2008 Van der Steen ..... G06K 13/08 439/188
7,661,974 B1 * 2/2010 Sun ..... H05K 7/1431 439/327
7,985,086 B1 * 7/2011 Sun ..... H01R 13/62988 439/157

OTHER PUBLICATIONS

U.S. Appl. No. 16/021,269, entitled "Memory Module Connector, Memory Module, Pivotable Latch, Method for a Memory Module Connector, Method for Forming a Memory Module Connector and Method for Forming a Memory Module", filed Jun. 28, 2018, 41 pages.

* cited by examiner

*Primary Examiner* — Hien D Vu
(74) *Attorney, Agent, or Firm* — Jordan IP Law, LLC

(57) ABSTRACT

An embodiment of a connector housing for a circuit board may include a connector body to receive the circuit board, and a relaxation mechanism mechanically coupled to the connector body to relax stress on the connector housing and maintain the circuit board received in the connector body under a load which exceeds a load threshold. Other embodiments are disclosed and claimed.

17 Claims, 7 Drawing Sheets

CONNECTOR WITH RELAXATION MECHANISM FOR LATCH

TECHNICAL FIELD

Embodiments generally relate to circuit board connectors. More particularly, embodiments relate to a connector with a relaxation mechanism for a latch.

BACKGROUND

Electrical components such as circuit boards may be mechanically and/or electrically coupled together with connectors. A memory card, such as a dual-inline memory module (DIMM) may include rows of electrical connections along an edge of the card. A memory card connector may include a plurality of pins to be soldered to a main/parent board (e.g., a motherboard) and a slot to receive the edge of the memory card with the electrical connections. An insertion/ejection latch may help to insert and retain the memory card in the connector, and also to eject the memory card from the connector.

BRIEF DESCRIPTION OF THE DRAWINGS

The various advantages of the embodiments will become apparent to one skilled in the art by reading the following specification and appended claims, and by referencing the following drawings, in which:

DESCRIPTION OF EMBODIMENTS

Various embodiments described herein may include a memory component and/or an interface to a memory component. Such memory components may include volatile and/or nonvolatile (NV) memory (NVM). Volatile memory may be a storage medium that requires power to maintain the state of data stored by the medium. Non-limiting examples of volatile memory may include various types of random access memory (RAM), such as dynamic RAM (DRAM) or static RAM (SRAM). One particular type of DRAM that may be used in a memory module is synchronous dynamic RAM (SDRAM). In particular embodiments, DRAM of a memory component may comply with a standard promulgated by Joint Electron Device Engineering Council (JEDEC), such as JESD79F for double data rate (DDR) SDRAM, JESD79-2F for DDR2 SDRAM, JESD79-3F for DDR3 SDRAM, JESD79-4A for DDR4 SDRAM, JESD209 for Low Power DDR (LPDDR), JESD209-2 for LPDDR2, JESD209-3 for LPDDR3, and JESD209-4 for LPDDR4 (these standards are available at www.jedec.org). Such standards (and similar standards) may be referred to as DDR-based standards and communication interfaces of the storage devices that implement such standards may be referred to as DDR-based interfaces.

NVM may be a storage medium that does not require power to maintain the state of data stored by the medium. In one embodiment, the memory device may include a block addressable memory device, such as those based on NAND or NOR technologies. A memory device may also include future generation nonvolatile devices, such as a three dimensional (3D) crosspoint memory device, or other byte addressable write-in-place nonvolatile memory devices. In one embodiment, the memory device may be or may include memory devices that use chalcogenide glass, multi-threshold level NAND flash memory, NOR flash memory, single or multi-level Phase Change Memory (PCM), a resistive memory, nanowire memory, ferroelectric transistor RAM (FeTRAM), anti-ferroelectric memory, magnetoresistive RAM (MRAM) memory that incorporates memristor technology, resistive memory including the metal oxide base, the oxygen vacancy base and the conductive bridge RAM (CB-RAM), or spin transfer torque (STT)-MRAM, a spintronic magnetic junction memory based device, a magnetic tunneling junction (MTJ) based device, a DW (Domain Wall) and SOT (Spin Orbit Transfer) based device, a thiristor based memory device, or a combination of any of the above, or other memory. The memory device may refer to the die itself and/or to a packaged memory product. In particular embodiments, a memory component with non-volatile memory may comply with one or more standards promulgated by the JEDEC, such as JESD218, JESD219, JESD220-1, JESD223B, JESD223-1, or other suitable standard (the JEDEC standards cited herein are available at jedec.org).

Figure 1:
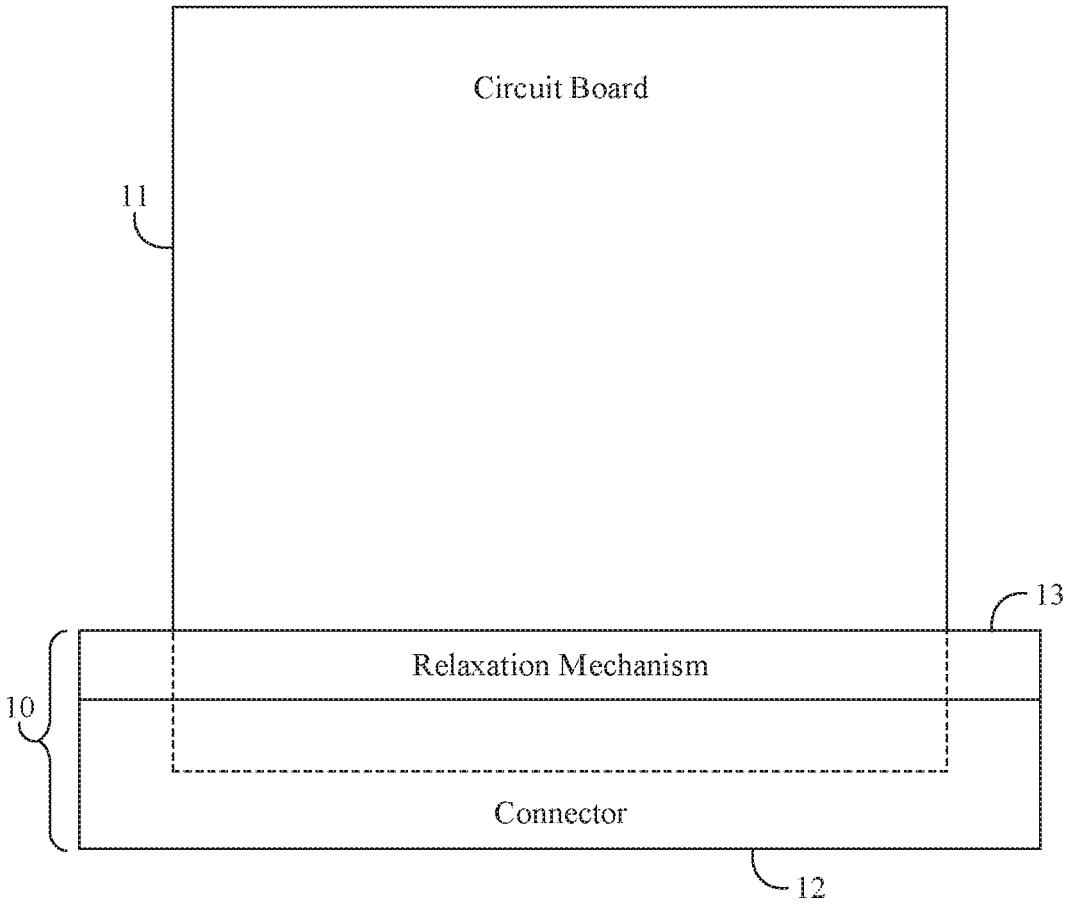
FIG. 1 is a block diagram of an example of a connector for a circuit board according to an embodiment.

Turning now to FIG. 1, an embodiment of a connector housing 10 for a circuit board 11 may include a connector body 12 to receive the circuit board 11, and a relaxation mechanism 13 mechanically coupled to the connector body 12 to relax stress on the connector housing 10 and maintain the circuit board 11 received in the connector body 12 under a load which exceeds a load threshold. In some embodiments, the relaxation mechanism 13 may include a latch to retain the circuit board 11 in the connector body 12, where the latch is mechanically coupled to the connector body 12 with a structure that allows translation of the latch under the load which exceeds the load threshold. For example, the structure that allows translation of the latch under the load which exceeds the load threshold may include a groove disposed in one of the connector body 12 and the latch to allow translation of the latch relative to the connector body 12 under the load which exceeds the load threshold.

In some embodiments, the groove may include a first pivot point to retain the circuit board 11 fully seated in the connector body 12 when a load on the latch is less than or equal to the load threshold, and a second pivot point to retain the circuit board 11 partially seated in the connector body 12 when the load on the latch exceeds the load threshold. In some embodiments, the connector housing 10 may further include a spring configured to allow the translation of the latch from the first pivot point to the second pivot point only when the load on the latch exceeds the load threshold (e.g., otherwise the latch is held at the first pivot point for normal operation under loads below the load threshold). In some embodiments, the connector body 12 may include a slot to receive the circuit board 11, and a lengthwise centerline of the groove may be substantially perpendicular to a lengthwise centerline of the slot. In some embodiments, the circuit board may include a memory card or a dual-inline memory module (DIMM).

Figure 2A:
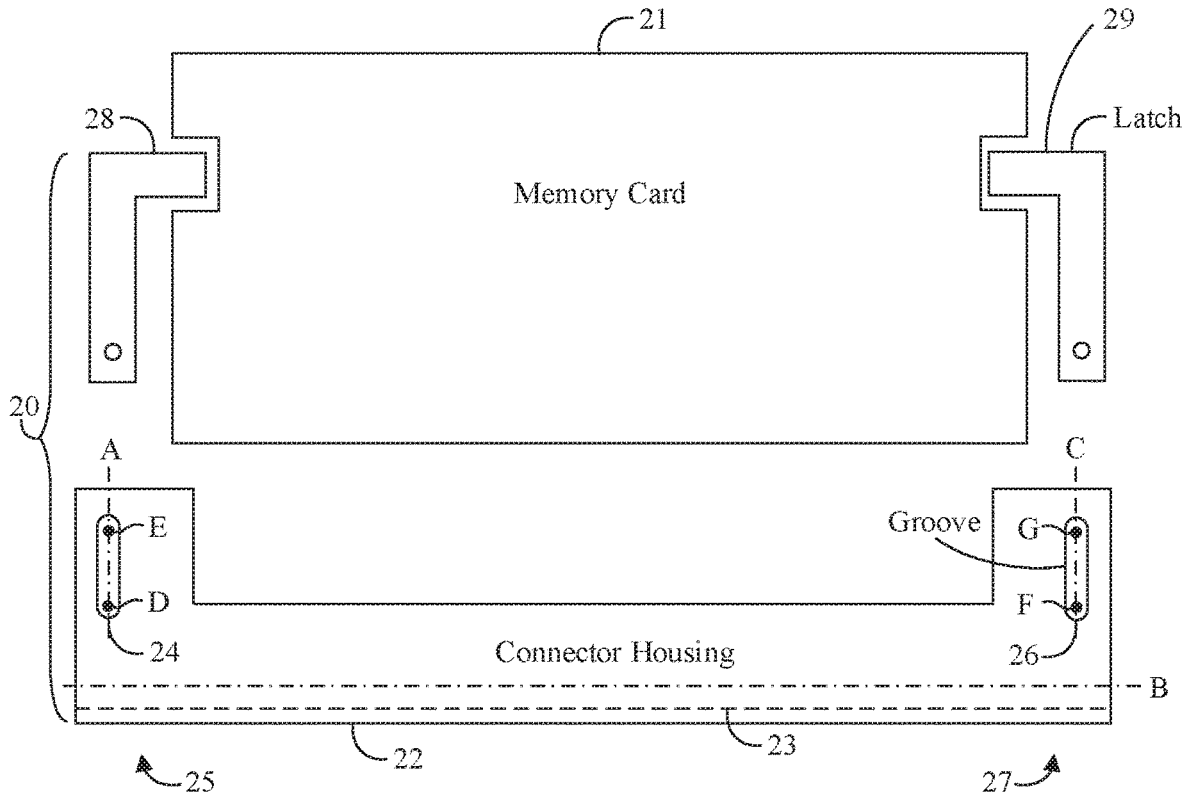
FIGS. 2A to 2C are block diagrams of an example of a connector for a memory card according to an embodiment.
Figure 2B:
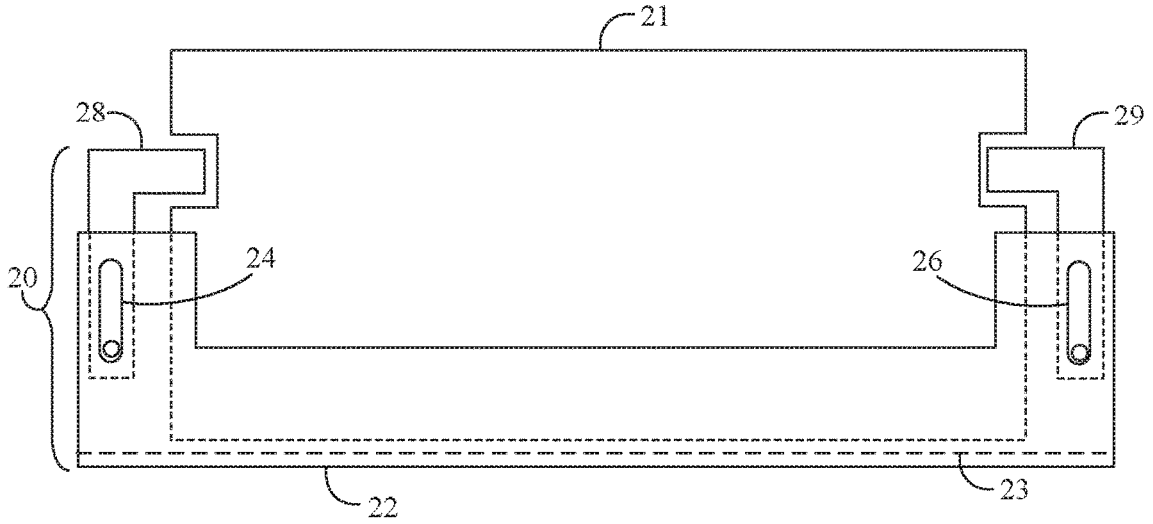
Figure 2C:
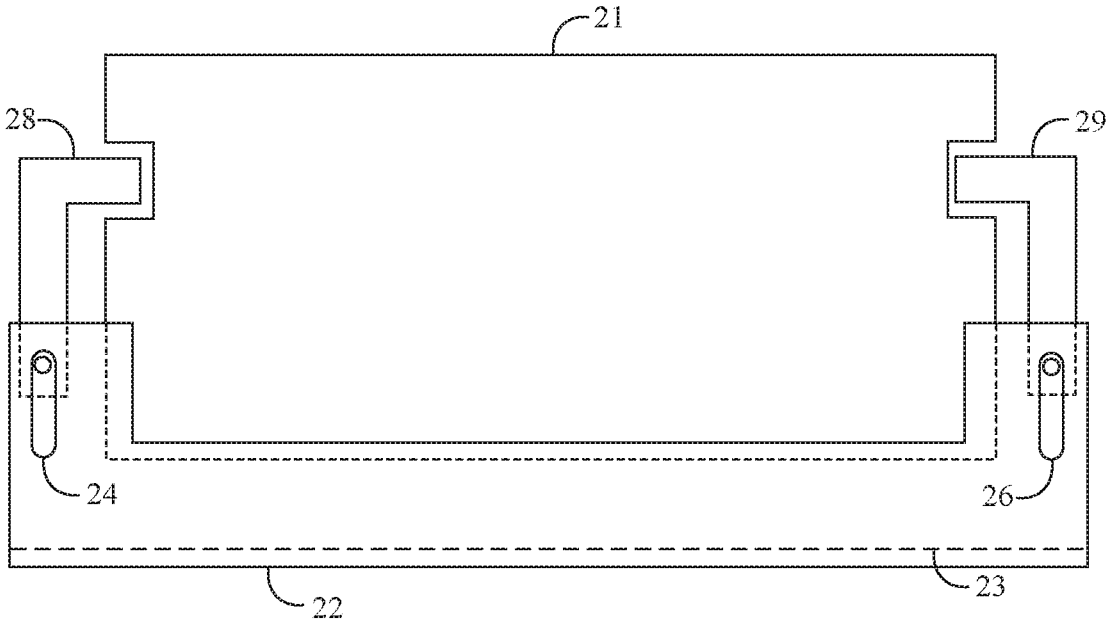

Turning now to FIGS. 2A to 2C, an embodiment of a connector 20 for a memory card 21 may include a connector housing 22 including an elongated slot 23 to receive the memory card 21, the connector housing 22 including a first set of opposed grooves 24 at a first end 25 of the elongated slot 23, and a second set of opposed grooves 26 at a second end 27 of the elongated slot 23 opposite to the first end 25. In some embodiments, a lengthwise centerline A of the first set of opposed grooves 24 is transverse to a lengthwise centerline B of the elongated slot 23, and a lengthwise centerline C of the second set of opposed grooves 26 is transverse to the lengthwise centerline B of the elongated slot 23. In some embodiments, a first latch 28 may be received within the first set of opposed grooves 24 of the connector housing 22, and a second latch 29 may be received within the second set of opposed grooves 26 of the connector housing 22. For example, the respective lengthwise centerlines A, C of the first and second sets of opposed grooves 24, 26 may be substantially perpendicular to the lengthwise centerline B of the elongated slot 23. For example, the memory card 21 may include a DIMM.

In some embodiments, the first set of opposed grooves 24 may include a first pivot point D at a first end of the first set of opposed grooves 24 and a second pivot point E at a second end of the first set of opposed grooves 24, and the second set of opposed grooves 26 may include a first pivot point F at a first end of the second set of opposed grooves 26 and a second pivot point G at a second end of the second set of opposed grooves 26. For example, the first set of opposed grooves 24 may include a first spring to allow translation of the first latch 28 between the first and second pivot points D, E of the first set of opposed grooves 24 only when a load on the first latch 28 exceeds a load threshold, and the second set of opposed grooves 26 may include a second spring to allow translation of the second latch 29 between the first and second pivot points F, G of the second set of opposed grooves 26 only when a load on the second latch 29 exceeds the load threshold. For example, the respective second pivot points E, G of the first and second sets of opposed grooves 24, 26 may be positioned relative to the respective first pivot points D, F of the first and second sets of opposed grooves 24, 26 to relax stress on the respective first and second latches 28, 29 under a shock load when the first and second latches 28, 29 are positioned at the respective second pivot points E, G.

FIG. 2A shows an exploded view of the connector 20 and memory card 21. FIG. 2B shows the latches 28, 29 received within their respective grooves 24, 26 and the memory card 21 fully seated within the connector housing 22 (e.g., with the latches 28, 29 positioned at the first pivot points D, F). Under normal load conditions, the latches 28, 29 may pivot about the first pivot points D, F to retain the memory card 21 fully seated within the connector housing 22. FIG. 2C shows the latches 28, 29 translated to the second pivot points E, G with the memory card 21 partially seated within the connector housing 22. Under a shock load, the grooves 24, 26 may allow the latches 28, 29 to translate to the second pivot points E, G to relax the stress on the latches 28, 29 while retaining the memory card 21 within the connector housing 22.

Figure 3A:
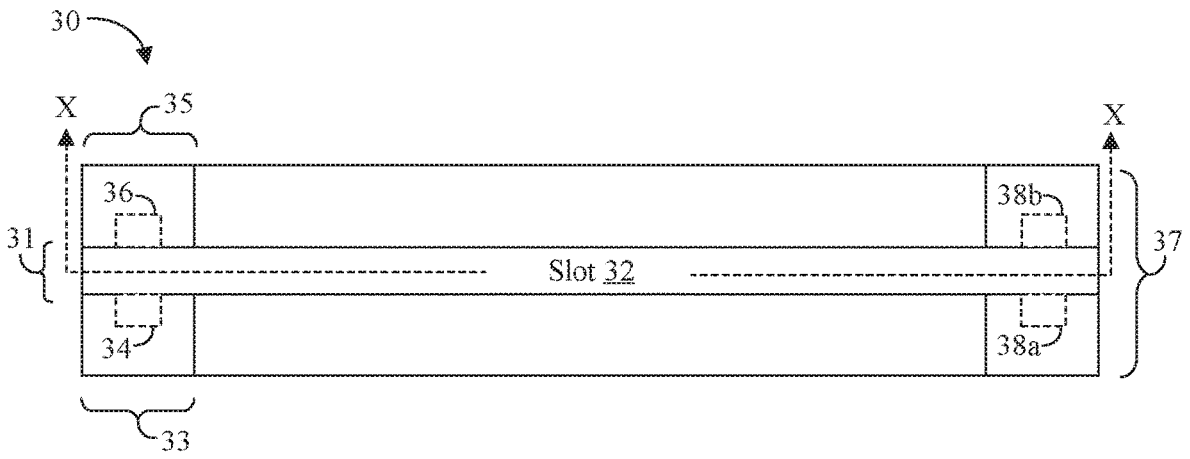
FIG. 3A is a top view of an example of a connector housing according to an embodiment.
Figure 3B:
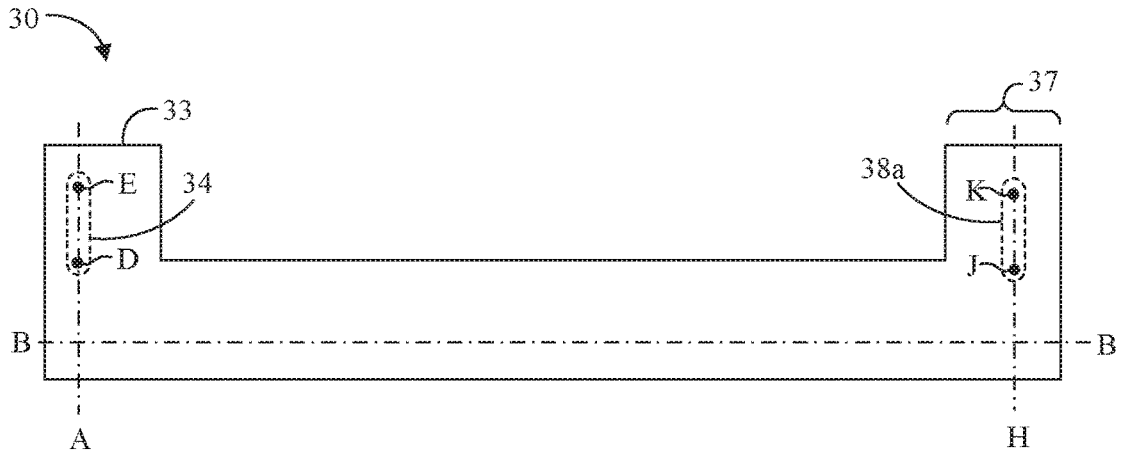
FIG. 3B is a front view of the connector housing from FIG. 3A.
Figure 3C:
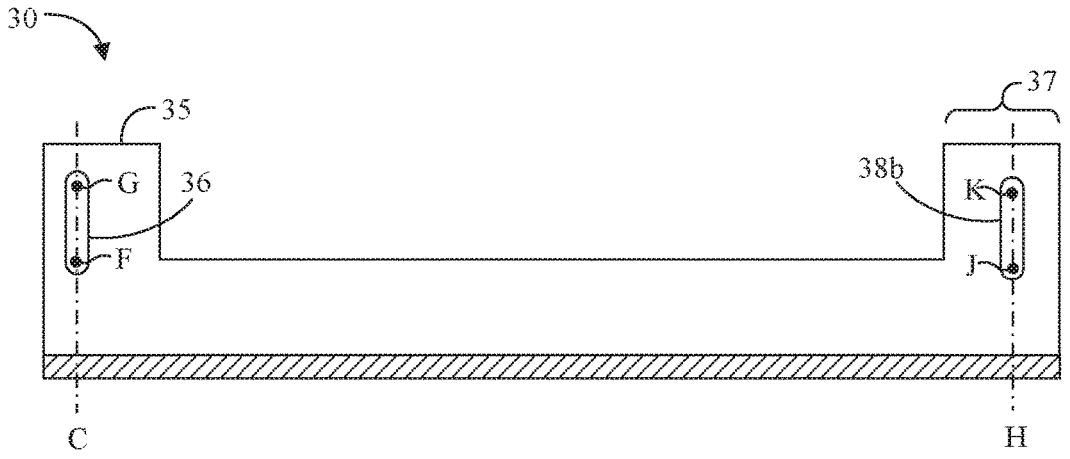
FIG. 3C is a sectional view of the connector housing taken along line X-X in FIG. 3A.

Turning now to FIGS. 3A to 3C, an embodiment of a connector housing 30 for a circuit board substrate may include a first housing portion 31 including an elongated slot 32 to receive the circuit board substrate, a second housing portion 33 mechanically coupled to the first housing portion 31 at an end of the elongated slot 32. The second housing portion 33 may include a first groove 34 to receive a latch, where a lengthwise centerline A of the first groove 34 is transverse to a lengthwise centerline B of the elongated slot 32. The connector housing 30 may further include a third housing portion 35 mechanically coupled to the first housing portion 31 at the end of the elongated slot 32 and opposed to the second housing portion 33. The third housing portion 35 may include a second groove 36 to receive the latch, where a lengthwise centerline of the second groove 36 is aligned to the lengthwise centerline A of the first groove 34 and the second groove 36 is directly opposed to the first groove 34. For example, the respective lengthwise centerlines A, C of the first and second grooves 34, 36 may be substantially perpendicular to the lengthwise centerline B of the elongated slot 32.

In some embodiments, the first groove 34 includes a first pivot point D at a first end of the first groove 34 and a second pivot point E at a second end of the first groove E, and the second groove 36 includes a first pivot point F at a first end of the second groove 36 and a second pivot point G at a second end of the second groove 36. For example, the first and second grooves 34, 36 may include a spring to allow translation of the latch between the respective first (D, F) and second (E, G) pivot points of the first and second grooves 34, 36 only when a load on the latch exceeds a load threshold. For example, the spring may include a spring mechanism provided by forming a constriction in one or both of the first and second grooves 34, 36. A resiliency or elasticity in the materials of the connector housing 30 (e.g., or in the material of the mating pins in the latch) may provide the spring force for the constriction. In some embodiments, the respective second pivot points (E, G) of the first and second grooves 34, 36 are positioned relative to the respective first pivot points (D, F) of the first and second grooves 34, 36 to relax stress on the latch under a shock load when the latch is positioned at the respective second pivot points (E, G). In some embodiments, the circuit board substrate may include a memory card, such as a DIMM.

In some embodiments, the connector housing 30 may further include a fourth housing portion 37 mechanically coupled to the first housing portion 31 at another end of the elongated slot 32 opposite of the second and third housing portions 33, 35. The fourth housing portion 37 may include a set of opposed grooves 38*a*, 38*b* to receive a second latch, where a lengthwise centerline H of the set of opposed grooves 38*a*, 38*b* is transverse to the lengthwise centerline C of the elongated slot 32, where the set of opposed grooves 38*a*, 38*b* includes a first pivot point J at a first end of the set of opposed grooves 38*a*, 38*b* and a second pivot point K at a second end of the set of opposed grooves 38*a*, 38*b*, and where the set of opposed grooves 38*a*, 38*b* includes a second spring (e.g., a second constriction) to allow translation of the second latch between the respective first and second pivot points J, K of the set of opposed grooves 38*a*, 38*b* only when a second load on the second latch exceeds a second load threshold.

Figure 4:
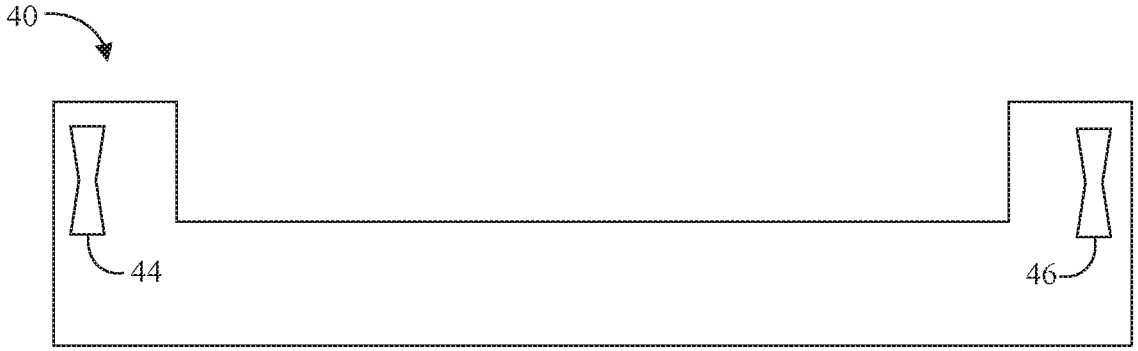
FIG. 4 is a front view of an example of another connector housing according to an embodiment.
Figure 5:
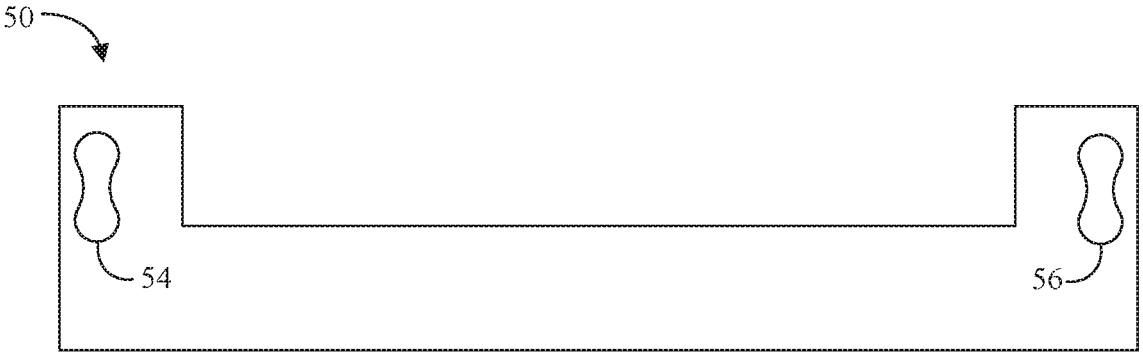
FIG. 5 is a front view of an example of another connector housing according to an embodiment.
Figure 6:
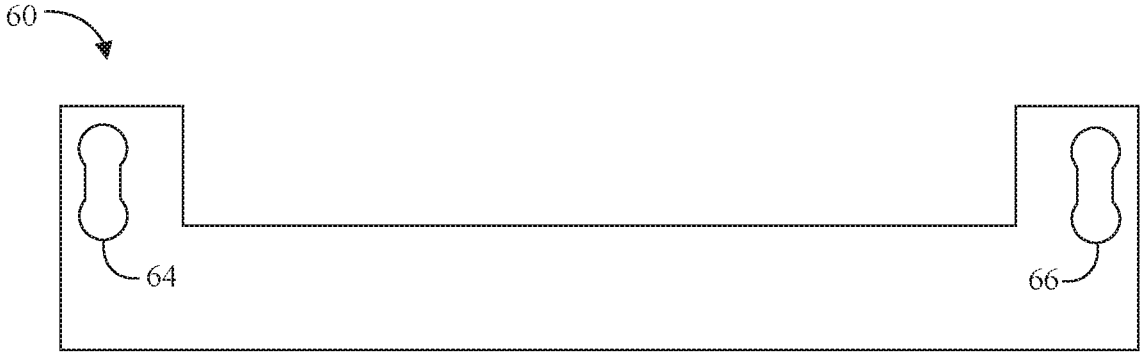
FIG. 6 is a front view of an example of another connector housing according to an embodiment.

Turning now to FIGS. 4 to 6, additional embodiments of connector housings 40, 50, and 60 include first and second sets of opposed grooves (44 and 46, 54 and 56, 64 and 66) at respective ends of the connector housings 40, 50, and 60. Connector housing 40 (FIG. 4) includes hourglass shaped grooves 44, 46 to form a spring mechanism with a constriction between respective pivot points at respective ends of the grooves 44, 46. Connector housing 50 (FIG. 5) includes curve shaped grooves 54, 56 to form a spring mechanism with a constriction between respective pivot points at respective ends of the grooves 54, 56. Connector housing 60 (FIG. 6) includes barbell shaped grooves 64, 66 to form a spring mechanism with a constriction between respective pivot points at respective ends of the grooves 64, 66. Given the benefit of the present specification and drawings, numerous other examples of suitable spring mechanisms will occur to those skilled in the art. Those skilled in the art will further appreciate that in other embodiments the pin structure may be provided on the connector housing while the groove structure may be provided on the latch.

Figure 7A:
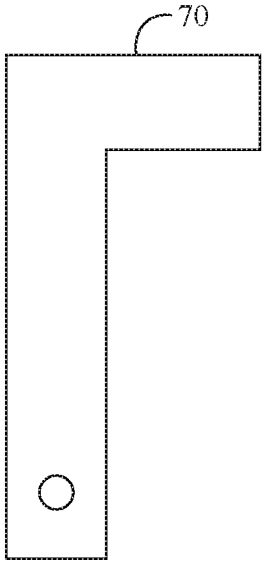
FIG. 7A is a side view of an example of a latch according to an embodiment.
Figure 7B:
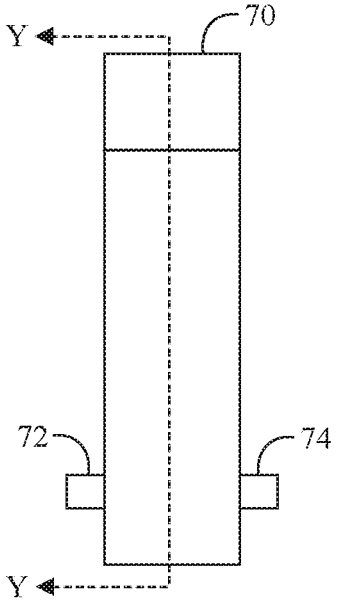
FIG. 7B is a front view of the latch from FIG. 7A.
Figure 7C:
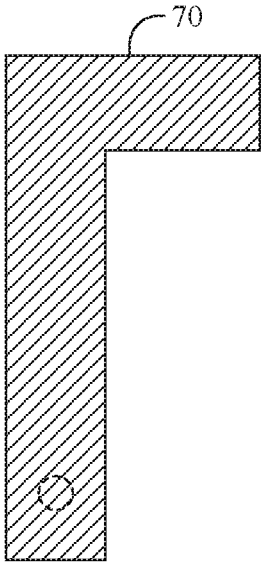
FIG. 7C is a sectional view of the latch taken along line Y-Y in FIG. 7B.

Turning now to FIGS. 7A to 7C, an embodiment of a latch 70 suitable for use with the connector housings described herein may include a set of opposed pins 72 and 74. The pins may snap into the grooves of the connector housing and may be of sufficient diameter to stay positioned at the pivot points unless acted on with sufficient load to translate the latch 70 and pins 72, 74 from one pivot point to the other pivot point. For example, the material of the pins 72, 74 and/or grooves may have a resiliency or elasticity to squeeze the pins 72, 74 between the constriction in the grooves under sufficient force.

Figure 8A:
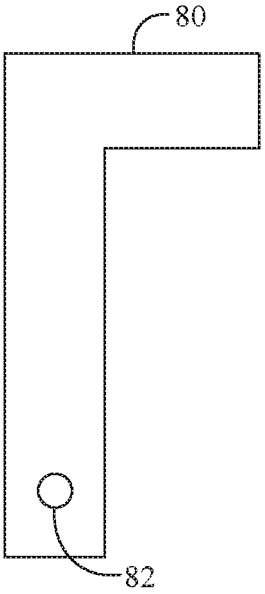
FIG. 8A is a side view of an example of another latch according to an embodiment.
Figure 8B:
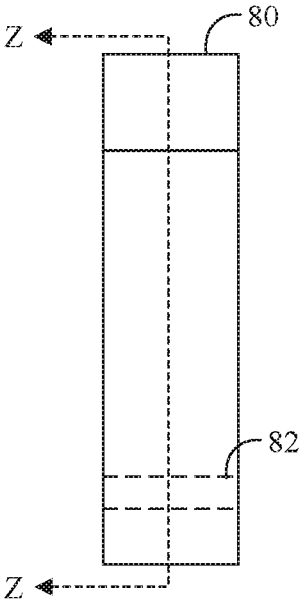
FIG. 8B is a front view of the latch from FIG. 8A.
Figure 8C:
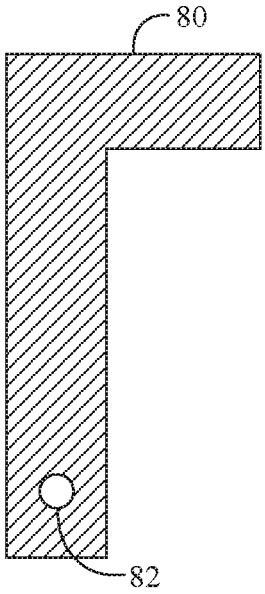
FIG. 8C is a sectional view of the latch taken along line Z-Z in FIG. 8B.

Turning now to FIGS. 8A to 8C, an embodiment of another latch 80 suitable for use with the connector housings described herein may include a hole 82 to receive a rod or pin (e.g., not shown, but made of metal, plastic, or other suitable material). The pin may snap into the grooves of the connector housing and may be of sufficient diameter to stay positioned at the pivot points unless acted on with sufficient load to translate the latch 80 and pin from one pivot point to the other pivot point. For example, the material of the pin and/or grooves may have a resiliency or elasticity to squeeze between the constriction in the grooves under sufficient force.

Some embodiments may advantageously provide a connector latch design with a relaxation mechanism for DIMM shock failure mitigation. With the increase of memory capacity on platform motherboards (e.g., 12, DIMMS, 24 DIMMs, 32 DIMMs, 48 DIMMs, etc.) and the increase of DIMM heat spreader mass (e.g., DDR4 DIMM heat spreader mass of 30 grams, 40 grams, 50 grams, 60 grams, etc.), a board level shock test may become a failure point (e.g., either an actual test failure or a simulated test failure). In one example with 48 DIMMs, the motherboard deflection may significantly higher because of the total DIMM mass as compared to platforms with fewer DIMMs. The increased mass may increase DIMM connector shock failure risk significantly due to the excessive board deflection.

A common DIMM connector failure mode under shock may include a broken latch. With a more robust design for the DIMM latch, another common shock failure mode is a DIMM connector solder joint j-lead pulling out of the connector housing. Both of these failure modes may have the same root cause of heavy DIMM mass. In addition, surface mounted DIMM connector solder joint shock failure risk will be increased with increased connector count and mass. At a component level, the DIMM mass is expected to increase due to increased thermal power. At a board level, the number of DIMMs is also expected to increase due to the need for increased memory capacity. The shock risk will continue to increase for DIMM connector failure and a solution at component level would be highly beneficial.

Some embodiments may advantageously mitigate failures under shock load with a DIMM connector latch design that includes a spring mechanism to allow a DIMM latch to extend under shock load and allows the DIMM to re-seat back to the DIMM connector after the shock load. Some embodiments advantageously allow more board flexure and reduce potential DIMM connector damage. Some embodiments may also avoid a more common DIMM pop out failure mode after shock tests. For example, some embodiments may include cooperating structures arranged between the connector body, the latch, and the circuit board to allow the circuit board to partially unseat under a heavy shock while retaining the circuit board in the connector body, such that the circuit board can be easily fully reseated.

Examples of suitable cooperating structures include any of a variety of slot/tab structures, pin/groove structures, rod/channel structures, etc., configured to allow translation of the latch under the shock load. When the circuit board becomes partially unseated due to the shock load, the stress on the latch and connector body may be significantly reduced (e.g., the motherboard may flex more while transferring less stress to the latch and/or connector body as compared to when the circuit board is fully seated). Advantageously, some embodiments may reduce or eliminate DIMM connector damage under shock load, save cost for various system level shock solutions (e.g., dampers, etc.), and may have no impact to routing on either the circuit board or the motherboard.

Figure 9A:
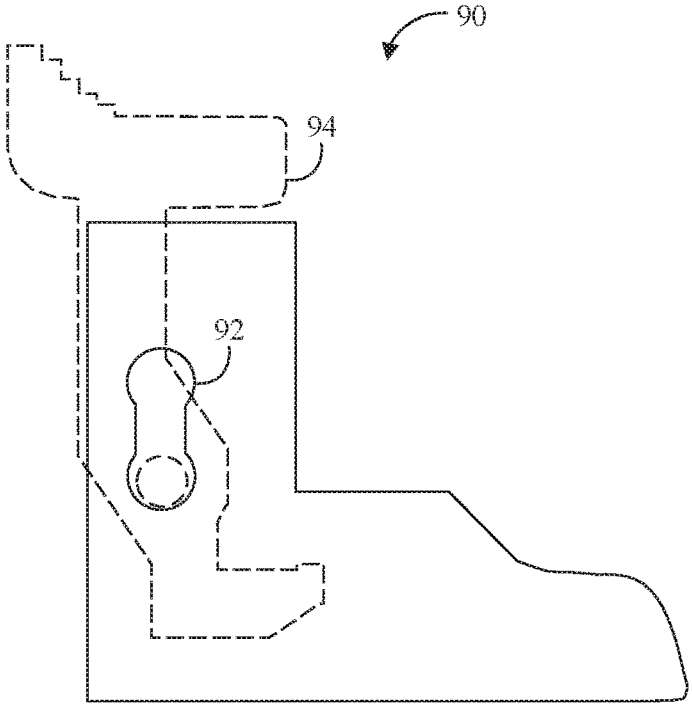
FIGS. 9A to 9B are partial cut-away front views of an example of another connector housing according to an embodiment.
Figure 9B:
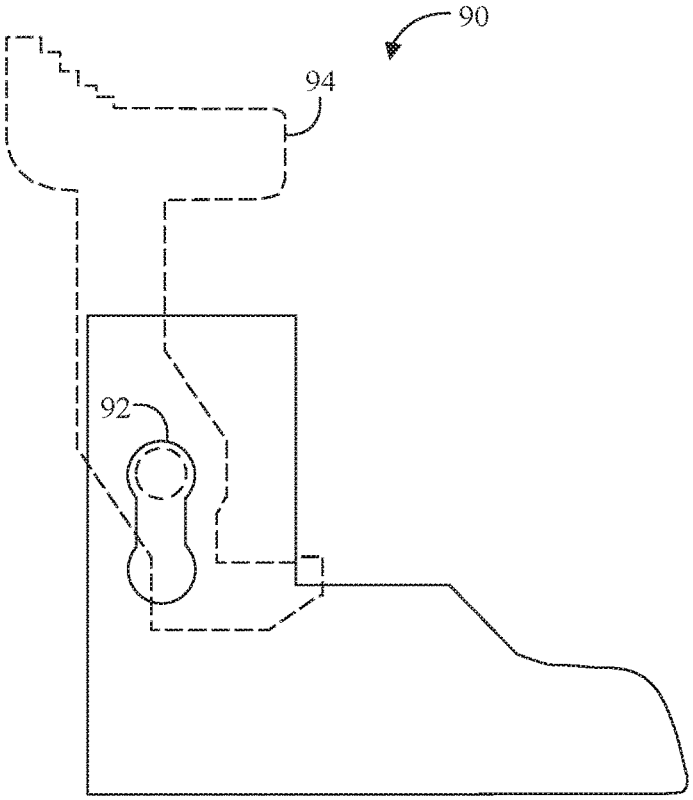

Turning now to FIGS. 9A to 9B, an embodiment of a connector housing 90 may include a barbell shaped groove 92 to receive an insertion/ejection latch 94. When the latch 94 is in the installed position, the groove 92 allows the latch 94 at the pivot to move from the bottom side (FIG. 9A) to the top side (FIG. 9B), when the pulling force exceeds designed threshold for shock load. During DIMM insertion and ejection (e.g., a normal installation process), the latch 94 will only rotate along the bottom pivot point without the vertical movement. The vertical movement happens only under high shock load, which relaxes the high stress to the latch 94, j-lead, and solder joints due to high board deflection. Advantageously, the latch 94 is captive and will not fall apart after the relaxation movement. Because the relaxation movement is visible, the latch 94 may be easily pushed down back to its original position if the shock load pulled the latch 94 up.

ADDITIONAL NOTES AND EXAMPLES

Example 1 includes a connector housing for a circuit board, comprising a connector body to receive the circuit board, and a relaxation mechanism mechanically coupled to the connector body to relax stress on the connector housing and maintain the circuit board received in the connector body under a load which exceeds a load threshold.

Example 2 includes the connector housing of Example 1, wherein the relaxation mechanism comprises a latch to retain the circuit board in the connector body, wherein the latch is mechanically coupled to the connector body with a structure that allows translation of the latch under the load which exceeds the load threshold.

Example 3 includes the connector housing of Example 2, wherein the structure that allows translation of the latch under the load which exceeds the load threshold comprises a groove disposed in one of the connector body and the latch to allow translation of the latch relative to the connector body under the load which exceeds the load threshold.

Example 4 includes the connector housing of Example 3, wherein the groove comprises a first pivot point to retain the circuit board fully seated in the connector when a load on the latch is less than or equal to the load threshold, and a second pivot point to retain the circuit board partially seated in the connector body when the load on the latch exceeds the load threshold.

Example 5 includes the connector housing of Example 4, further comprising a spring configured to allow the translation of the latch from the first pivot point to the second pivot point only when the load on the latch exceeds the load threshold.

Example 6 includes the connector housing of any of Examples 3 to 5, wherein the connector body includes a slot to receive the circuit board.

Example 7 includes the connector housing of Example 6, wherein a lengthwise centerline of the groove is substantially perpendicular to a lengthwise centerline of the slot.

Example 8 includes the connector housing of any of Examples 1 to 7, wherein the circuit board comprises a memory card.

Example 9 includes the connector housing of any of Examples 1 to 8, wherein the circuit board comprises a dual-inline memory module.

Example 10 includes a connector for a memory card, comprising a connector housing including an elongated slot to receive the memory card, the connector housing including a first set of opposed grooves at a first end of the elongated slot, wherein a lengthwise centerline of the first set of opposed grooves is transverse to a lengthwise centerline of the elongated slot, and a second set of opposed grooves at a second end of the elongated slot opposite to the first end wherein a lengthwise centerline of the second set of opposed grooves is transverse to the lengthwise centerline of the elongated slot, a first latch received within the first set of opposed grooves of the connector housing, and a second latch received within the second set of opposed grooves of the connector housing.

Example 11 includes the connector of Example 10, wherein the first set of opposed grooves include a first pivot point at a first end of the first set of opposed grooves and a second pivot point at a second end of the first set of opposed grooves, and the second set of opposed grooves include a first pivot point at a first end of the second set of opposed grooves and a second pivot point at a second end of the second set of opposed grooves.

Example 12 includes the connector of Example 11, wherein the first set of opposed grooves include a first spring to allow translation of the first latch between the first and second pivot points of the first set of opposed grooves only when a load on the first latch exceeds a load threshold, and the second set of opposed grooves include a second spring to allow translation of the second latch between the first and second pivot points of the second set of opposed grooves only when a load on the second latch exceeds the load threshold.

Example 13 includes the connector of any of Examples 11 to 12, wherein the respective second pivot points of the first and second sets of opposed grooves are positioned relative to the respective first pivot points of the first and second sets of opposed grooves to relax stress on the respective first and second latches under a shock load when the first and second latches are positioned at the respective second pivot points.

Example 14 includes the connector of any of Examples 10 to 13, wherein the respective lengthwise centerlines of the first and second sets of opposed grooves are substantially perpendicular to the lengthwise centerline of the elongated slot.

Example 15 includes the connector of any of Examples 10 to 14, wherein the memory card comprises a dual-inline memory module.

Example 16 includes a connector housing for a circuit board substrate, comprising a first housing portion including an elongated slot to receive the circuit board substrate, a second housing portion mechanically coupled to the first housing portion at an end of the elongated slot, the second housing portion including a first groove to receive a latch, wherein a lengthwise centerline of the first groove is transverse to a lengthwise centerline of the elongated slot, and a third housing portion mechanically coupled to the first housing portion at an end of the elongated slot and opposed to the second housing portion, the third housing portion including a second groove to receive the latch, wherein a lengthwise centerline of the second groove is aligned to the lengthwise centerline of the first groove and the second groove is directly opposed to the first groove.

Example 17 includes the connector housing of Example 16, wherein the first groove includes a first pivot point at a first end of the first groove and a second pivot point at a second end of the first groove, and the second groove includes a first pivot point at a first end of the second groove and a second pivot point at a second end of the second groove.

Example 18 includes the connector housing of Example 17, wherein the first and second grooves include a spring to allow translation of the latch between the respective first and second pivot points of the first and second grooves only when a load on the latch exceeds a load threshold.

Example 19 includes the connector housing of any of Examples 17 to 18, wherein the respective second pivot points of the first and second grooves are positioned relative to the respective first pivot points of the first and second grooves to relax stress on the latch under a shock load when the latch is positioned at the respective second pivot points.

Example 20 includes the connector housing of any of Examples 16 to 19, wherein the respective lengthwise centerlines of the first and second grooves are substantially perpendicular to the lengthwise centerline of the elongated slot.

Example 21 includes the connector housing of any of Examples 16 to 20, wherein the circuit board substrate comprises a memory card.

Example 22 includes the connector housing of any of Examples 16 to 21, wherein the circuit board substrate comprises a dual-inline memory module.

Example 23 includes the connector housing of any of Examples 16 to 22, further comprising a fourth housing portion mechanically coupled to the first housing portion at another end of the elongated slot opposite of the second and third housing portions, the fourth housing portion including a set of opposed grooves to receive a second latch, wherein a lengthwise centerline of the set of opposed grooves is transverse to the lengthwise centerline of the elongated slot, wherein the set of opposed grooves includes a first pivot point at a first end of the set of opposed grooves and a second pivot point at a second end of the set of opposed grooves, and wherein the set of opposed grooves include a second spring to allow translation of the second latch between the respective first and second pivot points of the set of opposed grooves only when a second load on the second latch exceeds a second load threshold.

Example 24 includes a connector for a circuit board substrate, comprising slot means for receiving the circuit board substrate, latch means for retaining the circuit board substrate in the slot means, and relaxation means for relaxing stress on the latch means during a shock load on the latch means while retaining the circuit board substrate.

Example 25 includes the connector of Example 24, wherein the relaxation means comprises groove means for allowing translation of the latch means during the shock load.

Example 26 includes the connector of Example 25, wherein the groove means comprises first pivot means for retaining the circuit board in the slot means when a load on the latch means is less than or equal to a load threshold, and second pivot means for retaining the circuit board when the load on the latch means exceeds the load threshold.

Example 27 includes the connector of any of Examples 25 to 26, further comprising spring means for allowing translation of the latch means only when a load on the latch means exceeds a load threshold.

Example 28 includes the connector of any of Examples 25 to 27, wherein respective lengthwise centerlines of the groove means are substantially perpendicular to a lengthwise centerline of the slot means.

Example 29 includes the connector of any of Examples 24 to 28, wherein the circuit board substrate comprises a memory card.

Example 30 includes the connector of any of Examples 24 to 29, wherein the circuit board substrate comprises a dual-inline memory module.

Embodiments are applicable for use with all types of semiconductor integrated circuit ("IC") chips. Examples of these IC chips include but are not limited to processors, controllers, chipset components, programmable logic arrays (PLAs), memory chips, network chips, systems on chip (SoCs), SSD/NAND controller ASICs, and the like. In addition, in some of the drawings, signal conductor lines are represented with lines. Some may be different, to indicate more constituent signal paths, have a number label, to indicate a number of constituent signal paths, and/or have arrows at one or more ends, to indicate primary information flow direction. This, however, should not be construed in a limiting manner. Rather, such added detail may be used in connection with one or more exemplary embodiments to facilitate easier understanding of a circuit. Any represented signal lines, whether or not having additional information, may actually comprise one or more signals that may travel in multiple directions and may be implemented with any suitable type of signal scheme, e.g., digital or analog lines implemented with differential pairs, optical fiber lines, and/or single-ended lines.

Example sizes/models/values/ranges may have been given, although embodiments are not limited to the same. As manufacturing techniques (e.g., photolithography) mature over time, it is expected that devices of smaller size could be manufactured. In addition, well known power/ground connections to IC chips and other components may or may not be shown within the figures, for simplicity of illustration and discussion, and so as not to obscure certain aspects of the embodiments. Further, arrangements may be shown in block diagram form in order to avoid obscuring embodiments, and also in view of the fact that specifics with respect to implementation of such block diagram arrangements are highly dependent upon the platform within which the embodiment is to be implemented, i.e., such specifics should be well within purview of one skilled in the art. Where specific details (e.g., circuits) are set forth in order to describe example embodiments, it should be apparent to one skilled in the art that embodiments can be practiced without, or with variation of, these specific details. The description is thus to be regarded as illustrative instead of limiting.

The term "coupled" may be used herein to refer to any type of relationship, direct or indirect, between the components in question, and may apply to electrical, mechanical, fluid, optical, electromagnetic, electromechanical or other connections. In addition, the terms "first", "second", etc. may be used herein only to facilitate discussion, and carry no particular temporal or chronological significance unless otherwise indicated.

As used in this application and in the claims, a list of items joined by the term "one or more of" may mean any combination of the listed terms. For example, the phrase "one or more of A, B, and C" and the phrase "one or more of A, B, or C" both may mean A; B; C; A and B; A and C; B and C; or A, B and C.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

We claim:

1. An electrical connector housing for a circuit board, comprising:

a connector body to receive the circuit board; and a relaxation mechanism mechanically coupled to the connector body, the relaxation mechanism comprising:

a groove comprising a pair of pivot points connected via a constriction region, a latch comprising a pin, wherein the pin is operatively associated with the groove, wherein the relaxation mechanism is to relax stress on the connector housing, wherein the constriction region is configured to maintain the circuit board received in the connector body under a load which exceeds a load threshold, wherein the pin will stay positioned at either of the pivot points unless acted on with sufficient load to overcome the constriction region to translate the latch and pin from one pivot point to the other pivot point; and wherein a lengthwise centerline of the groove is substantially perpendicular to a lengthwise centerline of the slot.

2. The electrical connector housing of claim 1, wherein the relaxation mechanism comprises:

the latch to retain the circuit board in the connector body when the latch is in a first position, wherein the latch is translatably mechanically coupled to the connector body with a translation of the latch from the first position to a second different position under the load which exceeds the load threshold.

3. The electrical connector housing of claim 2, wherein the structure that allows translation of the latch under the load which exceeds the load threshold comprises:

the groove disposed in one of the connector body and the latch to allow translation of the latch relative to the connector body under the load which exceeds the load threshold.

4. The electrical connector housing of claim 3, wherein the groove comprises:

a first pivot point of the pair of pivot points to retain the circuit board fully seated in the connector when a load on the latch is less than or equal to the load threshold; and a second pivot point of the pair of pivot points to retain the circuit board partially seated in the connector body when the load on the latch exceeds the load threshold.

5. The electrical connector housing of claim 4, further comprising:

the constriction configured to allow the translation of the latch from the first pivot point to the second pivot point only when the load on the latch exceeds the load threshold.

6. The electrical connector housing of claim 3, wherein the connector body includes a slot to receive the circuit board.

7. The electrical connector housing of claim 6, wherein the circuit board comprises a memory card.

8. The electrical connector housing of claim 6, wherein the circuit board comprises a dual-inline memory module.

9. An electrical connector for a memory card, comprising: a connector housing including an elongated slot to receive the memory card, the connector housing including:

a first set of opposed grooves at a first end of the elongated slot, wherein a lengthwise centerline of the first set of opposed grooves is transverse to a lengthwise centerline of the elongated slot, and a second set of opposed grooves at a second end of the elongated slot opposite to the first end wherein a lengthwise centerline of the second set of opposed grooves is transverse to the lengthwise centerline of the elongated slot, wherein at least a portion of one or more of the first set or the second set comprising a pair of pivot points connected via a constriction region, and wherein the constriction region is configured to maintain the memory card received in the connector housing under a load which exceeds a load threshold;

a first latch received within the first set of opposed grooves of the connector housing; and a second latch received within the second set of opposed grooves of the connector housing, wherein at least a portion of one or more of the first latch or the second latch comprising a pin, wherein the pin is operatively associated with the pair of pivot points connected via the constriction region, wherein the pin will stay positioned at either of the pivot points unless acted on with sufficient load to overcome the constriction region to translate the latch and pin from one pivot point to the other pivot point; and wherein the respective lengthwise centerlines of the first and second sets of opposed grooves are substantially perpendicular to the lengthwise centerline of the elongated slot.

10. The electrical connector of claim 9, wherein the first set of opposed grooves include a first pivot point at a first end of the first set of opposed grooves and a second pivot point at a second end of the first set of opposed grooves, and the second set of opposed grooves include a first pivot point at a first end of the second set of opposed grooves and a second pivot point at a second end of the second set of opposed grooves.

11. The electrical connector of claim 10, wherein the first set of opposed grooves have a first constriction therein to allow translation of the first latch between the first and second pivot points of the first set of opposed grooves only when a load on the first latch exceeds the load threshold, and the second set of opposed grooves have a second constriction therein to allow translation of the second latch between the first and second pivot points of the second set of opposed grooves only when a load on the second latch exceeds the load threshold.

12. The electrical connector of claim 10, wherein the respective second pivot points of the first and second sets of opposed grooves are positioned relative to the respective first pivot points of the first and second sets of opposed grooves to relax stress on the respective first and second latches under a shock load when the first and second latches are positioned at the respective second pivot points.

13. The electrical connector of claim 9, wherein the memory card comprises a dual-inline memory module.

14. An electrical connector housing for a circuit board substrate, comprising:

a first housing portion including an elongated slot to receive the circuit board substrate;

a second housing portion mechanically coupled to the first housing portion at an end of the elongated slot, the second housing portion including a first groove to receive a latch, wherein a lengthwise centerline of the first groove is transverse to a lengthwise centerline of the elongated slot; and a third housing portion mechanically coupled to the first housing portion at an end of the elongated slot and opposed to the second housing portion, the third housing portion including a second groove to receive the latch, wherein a lengthwise centerline of the second groove is aligned to the lengthwise centerline of the first groove and the second groove is directly opposed to the first groove, wherein at least a portion of one or more of the first groove or the second groove comprising a pair of pivot points connected via a constriction region, and wherein the constriction region is configured to maintain the circuit board substrate received in the first housing portion under a load which exceeds a load threshold, wherein a pin portion of the latch is operatively associated with the pair of pivot points connected via the constriction region, wherein the pin will stay positioned at either of the pivot points unless acted on with sufficient load to overcome the constriction region to translate the latch and pin from one pivot point to the other pivot point; and wherein the respective lengthwise centerlines of the first and second grooves are substantially perpendicular to the lengthwise centerline of the elongated slot.

15. The electrical connector housing of claim 14, wherein the first groove includes a first pivot point at a first end of the first groove and a second pivot point at a second end of the first groove, and the second groove includes a first pivot point at a first end of the second groove and a second pivot point at a second end of the second groove.

16. The electrical connector housing of claim 15, wherein the first and second grooves have a constriction therein to allow translation of the latch between the respective first and second pivot points of the first and second grooves only when a load on the latch exceeds the load threshold.

17. The electrical connector housing of claim 15, wherein the respective second pivot points of the first and second grooves are positioned relative to the respective first pivot points of the first and second grooves to relax stress on the latch under a shock load when the latch is positioned at the respective second pivot points.

* * * * *